US005430603A

United States Patent [19]

Albino et al.

[11] Patent Number: 5,430,603

[45] Date of Patent: Jul. 4, 1995

[54] EXTERNALLY NON-CONDUCTIVE HOSE ASSEMBLY

[75] Inventors: Mark F. Albino, Belchertown; Ralph T. Blanchard, Feeding Hills, both of Mass.; John C. Dalton, North Granby, Conn.

[73] Assignee: Titeflex Corporation, Springfield, Mass.

[21] Appl. No.: 201,766

[22] Filed: Feb. 25, 1994

[51] Int. Cl.[6] ..... H05F 3/00

[52] U.S. Cl. ..... 361/215; 138/125; 138/DIG. 3; 174/47

[58] Field of Search ..... 361/212, 215, 220; 138/123, 124, 125

[56] References Cited

U.S. PATENT DOCUMENTS 3,109,461 11/1963 Wolff et al. ..... 138/137
3,857,415 12/1974 Morin et al. ..... 138/122
4,657,049 4/1987 Fourty et al. ..... 138/133
4,746,381 5/1988 Parker et al. ..... 156/69
5,105,854 4/1992 Cole et al. ..... 138/109
5,143,122 9/1992 Adkins ..... 138/109
5,361,806 11/1994 Lalikos et al. ..... 138/109

*Primary Examiner*—Jeffrey A. Gaffin
*Attorney, Agent, or Firm*—Mary R. Bonzagni; Holland & Associates

[57] ABSTRACT

An externally non-conductive hose assembly is provided which is made up of a hollow cylindrical member novelly connected to coupling means, where the connection prevents the dissipation of electrical charges therethrough and has sufficient strength to withstand severe torsional stresses and provides a seal to substantially preclude the undesired and gradual escape of fluids over the lifetime of the assembly.

6 Claims, 1 Drawing Sheet

EXTERNALLY NON-CONDUCTIVE HOSE ASSEMBLY

BACKGROUND OF THE INVENTION

1. Field of the Invention

This invention relates generally to an externally non-conductive hose assembly made up of a hollow cylindrical member and coupling means. This invention further relates to a method of mechanically connecting and sealing the hollow cylindrical member to coupling means. The subject hose assembly is a reinforced hose assembly of the type particularly well adapted for carrying fluids (i.e., fuels, hydraulic oil, brake fluids, etc.) and other aggressive or degrading fluids.

2. Description of the Related Art

Hose assemblies for carrying machinery or vehicle fluids are known. These assemblies, in vehicle or automotive applications, are typically routed through engine compartments that reach temperatures ranging from −40° F. to 400° F. and carry fluids that have the potential to chemically erode, swell or otherwise degrade the interior of the hose assemblies. Therefore, these assemblies, by necessity, have to be resistant to thermal and chemical degradation. Moreover, these hose assemblies need to resist kinking during installation, use and service. Hose assemblies which include an inner Teflon® tube or cylindrical member surrounded by loosely to tightly wound metallic braid have been found to provide these necessary physical characteristics. However, the danger exists that the buildup of electricity in a piece of machinery or equipment or in the engine compartment itself may cause premature failure of such assemblies by discharging current along the conductive path formed by the end fittings and the metallic braid. Accordingly, it is common practice to provide, in the case of automobiles, such engine compartments with ground straps that conduct electricity to the vehicle frame. Yet, on occasion, typically following vehicle service or maintenance (which necessitates the disconnection of such ground straps) manual reconnection of these straps fails to occur. As a result, such hose assemblies serve as conductive paths to ground within the engine compartment causing the reinforcing layer or braid to generate heat. The generated heat, over time, serves to melt or soften the Teflon® tube or member resulting in premature leakage. In automobile fuel lines, such leakage could result in engine fires.

It is therefore an object of the present invention to provide a hose assembly that is externally non-conductive.

It is a further object of the present invention to provide a method of mechanically connecting and sealing a hollow cylindrical member to coupling means thereby providing such an externally non-conductive hose assembly.

SUMMARY OF THE INVENTION

The present invention therefore provides an externally non-conductive hose assembly. In particular, the present invention provides a hose assembly comprising a hollow cylindrical member novelly connected to coupling means. The hollow cylindrical member comprises: an inner liner having an interior, an exterior and a first end; and a conductive reinforcing layer, disposed about the exterior of the inner liner, and having a first end. The coupling means comprises: a conductive connecting member having an engaging portion for engaging a fitting, an insert portion for engaging the interior of the inner liner and a stop bead disposed between the engaging portion and the insert portion; and a conductive locking collar, disposed about the first end of the reinforcing layer, for forcing the interior of the inner liner into engagement with the insert portion of the connecting member. The first end of the inner liner abuts and conforms to at least a portion of the stop bead for preventing the connecting member from physically and electrically contacting the locking collar and the first end of the reinforcing layer.

The present invention further provides a method of mechanically connecting and sealing the hollow cylindrical member to the coupling means of the hose assembly described hereinabove, comprising the steps of:

1. annularly cutting the reinforcing layer at a distance from the first end of the inner liner so as to expose a portion of the inner liner thereby forming a first end of the reinforcing layer;
2. positioning a conductive locking collar on the first end of the reinforcing layer;
3. inserting the insert portion of the conductive connecting member into the interior of the inner liner; and
4. applying a force to the locking collar so as to cause the interior of the inner liner to engage with the insert portion of the connecting member, where the force applied is sufficient to cause the first end of the inner liner to flow and conform to at least a portion of the stop bead thereby preventing the connecting member from physically and electrically contacting the locking collar and the first end of the reinforcing layer.

DESCRIPTION OF THE PREFERRED EMBODIMENT

Figure 1:
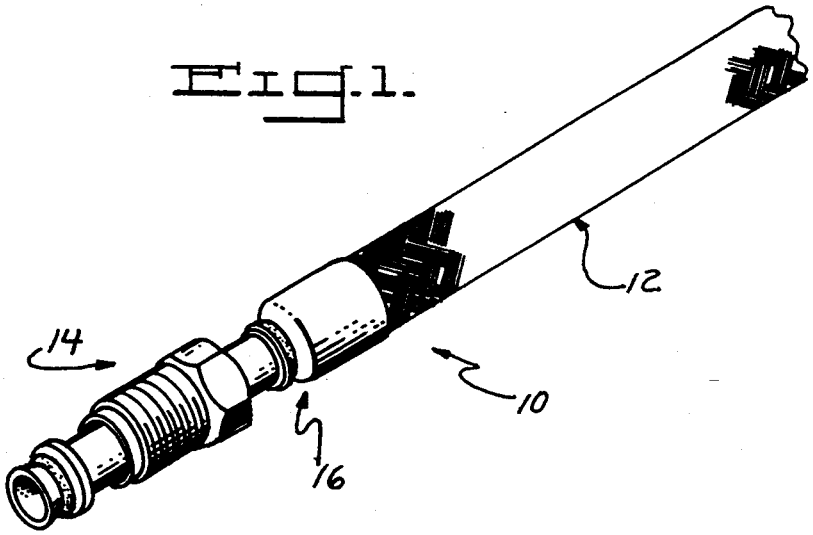
FIG. 1 is a perspective view of a hose assembly having a hollow cylindrical member novelly connected to coupling means in accordance with the present invention.

Referring to the drawings in detail, the hose assembly of the present invention is shown generally at 10. As best shown in FIG. 1, the hose assembly 10 is comprised of a hollow cylindrical member 12 and coupling means 14. Where the present inventive hose assembly overcomes the disadvantages of prior art hose assemblies by provision of a novel connection between hollow cylindrical member 12 and coupling means 14 and where such a connection would preferably be made to both ends of hose assembly 10, it is submitted that for ease of reference, only the connection to a first end 16 of hollow cylindrical member 12 will be discussed herein. It is noted however, that where such a novel connection is made to only end of hose assembly 10, the benefits of the present invention are still realized.

Figure 2:
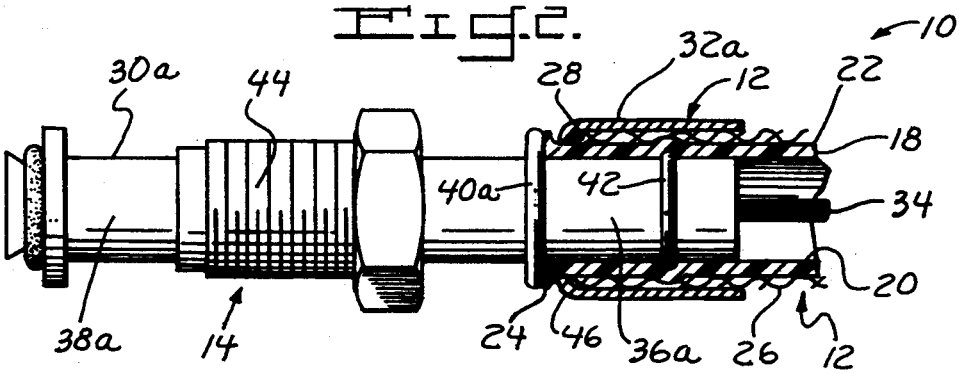
FIG. 2 shows the assembly of FIG. 1, with its hollow cylindrical member and a portion of its coupling means shown in cross-section, with portions broken away.

Referring in particular to FIG. 2, the hollow cylindrical member 12 comprises an inner liner 18 having an interior 20, an exterior 22 and a first end 24 and a conductive reinforcing layer 26, disposed about the exterior 22 of the inner liner 18, and having a first end 28. The coupling means 14 comprises at least one conductive connecting member 30*a* (having a stop bead 40*a*) for engaging a fitting (not shown) and for engaging the interior 20 of the inner liner 18, and at least one conductive locking collar 32*a*, disposed about the first end 28 of the reinforcing layer 26, for forcing the interior 20 of the inner liner 18 into engagement with the connecting member 30*a*. The first end 24 of the inner liner 18 abuts and conforms to at least a portion of the stop bead 40*a* for preventing the conductive connecting member 30*a* from physically and electrically contacting the conductive locking collar 32*a* and the first end 28 of the reinforcing layer 26. The hose assembly 10 of the present invention can further comprise a conductive means 34 for dissipating any static electrical charges in the fluid within the hollow cylindrical member 12 caused by the flow of fluids therethrough and/or a non-conductive or dielectric washer (not shown) located between the locking collar 32*a* and the stop bead 40*a*.

The inner liner 18 of the hollow cylindrical member 12 preferably has a wall thickness ranging from about 0.13 millimeters (mm) to about 1.9 mm and has an inner diameter ranging from about 2.5 mm to about 50.8 mm. The inner liner 18 can be made of any polymeric material that is extrudable or moldable and that has a compressive strength of from about 3.4 megapascals (MPa) to about 310 MPa. Such materials include fluorocarbon polymers, polyamides, polyethylene resins, polyesters, polyimides, polypropylene, polyvinylchloride, silicones, and mixtures thereof. Preferably, the inner liner 18 is made of a fluorocarbon polymer such as polytetrafluoroethylene (PTFE), copolymers of tetrafluoroethylene and hexafluoropropylene (FEP), perfluroalkoxyl resins (PFA) and polymers of ethylenetetrafluoroethylene (ETFE). PTFE, FEP and PFA are sold by E.I. DuPont De Nemours, Inc., Wilmington, DE, under the trademark TEFLON®. ETFE is also sold by DuPont under the trademark TEFZEL®. The preferred inner liner 18 is resistant to heat and chemical degradation and therefore can effectively accommodate a wide variety of aggressive or degrading fluids, such as hydraulic oils, fuels or brake fluids.

The conductive reinforcing layer 26 can comprise any conductive material loosely or tightly braided, woven or wound about the exterior 22 of the inner liner 18. Such materials include carbon, carbon steel, copper, brass, stainless steel and alloys thereof. Preferably, the material used for the conductive reinforcing layer 26 is stainless steel. The first end 28 of the reinforcing layer 26 is located from about 1.3 mm to about 27.9 mm from the first end 24 of the inner liner 18. In a more preferred embodiment of the present inventive hose assembly 10, the first end 28 of the reinforcing layer 26 is fused so as to prevent subsequent unraveling.

Coupling means 14 is for connecting the hollow cylindrical member 12 to fittings (not shown) for conducting fluid therethrough which are adapted to cooperate with coupling means 14. The conductive connecting member 30*a* of coupling means 14 comprises an insert portion 36*a* and an engaging portion 38*a* separated by stop bead 40*a*. Stop bead 40*a* may adopt any configuration that serves to change the direction of the axial flow of the inner liner 18 during a mechanical process whereby hollow cylindrical member 12 is sealably connected to coupling means 14. These configurations include stops, bumps, shoulders, tube upsets and beads, but it will be readily recognized by those skilled in the art that other configurations for stop bead 40*a* may be used in the present invention. The insert portion 36*a* may have one or more annular ridges 42, a plurality of tapered barbs (not shown) or any other means for engaging the interior 20 of the inner liner 18. The engaging portion 38*a* may comprise a male threaded member 44, a female threaded member (not shown) or a combination male/female threaded member (not shown). The engaging portion 38*a* may also comprise any configuration adapted to cooperate with a fitting to which it is attached. The conductive locking collar 32*a* of the coupling means 14 is disposed about the first end 28 of the reinforcing layer 26. It is noted herein, however, that for certain low pressure applications the need for locking collars is obviated. In a preferred embodiment, locking collar 32*a* has a first annular end 46 that tapers inwardly and contacts the exterior 22 of the inner liner 18. The minimum inner diameter of the locking collar 32*a* preferably ranges from about 3.8 mm to about 63.5 mm and it is preferred that the locking collar 32*a* be disposed about the first end 28 of the reinforcing layer 26, such that the distance from the first annular end 46 to the first end 24 of the inner liner 18 is from about 0.76 mm to about 25.4 mm. Suitable materials for the connecting member 30*a* and for the locking collar 32*a* include plated carbon-steel, brass, stainless steel and conductive plastic with stainless steel being preferred.

In applications where the potential exists for the build-up of static electrical charges throughout the length of the inner liner 18 caused by fluid flow therethrough, it is preferred that the hollow cylindrical member 12 of the present invention further comprise a conductive means 34 that is coextensive with the interior 20 of the inner liner 18. The conductive means 34 can preferably take the form of a conductive strip along the length of the inner liner 18 or the whole interior 20 of the inner liner 18 can comprise the conductive means 34. The material used for the conductive means 34 is preferably carbon black, but it will be recognized by those skilled in the art that other conductive materials may be used to form the conductive means 34 of the present invention.

As additional protection against the formation of unintentional conductive paths between the connecting member 30*a* and the locking collar 32*a* and reinforcing layer 26, the hose assembly 10 of the present invention can further comprise a non-conductive or dielectric washer located between the stop bead 40*a* and the locking collar 32*a*. In particular, the dielectric washer may abut stop bead 40*a* with the first end 24 of inner liner 18 abutting and conforming to at least a portion of the washer; or the washer may abut the locking collar 32*a* with the first end 24 of inner liner 18 abutting and conforming to at least a portion of stop bead 40*a*. The washer can be made of any non-conductive or dielectric material and is preferably made of the same material as the inner liner 18.

In a preferred process for preparing the hose assembly 10 of the present invention, a hollow cylindrical member 12 is provided whereby the hollow cylindrical member 12 has been prepared by extruding a fluorocarbon polymer to form an inner liner 18 having a first end 24, a wall thickness of from about 0.13 mm to about 1.9 mm and an inner diameter of from about 2.5 mm to about 50.8 mm, and by braiding, weaving or winding a metallic material about the exterior 22 of the inner liner 18 to form a reinforcing layer 26.

Figure 3:
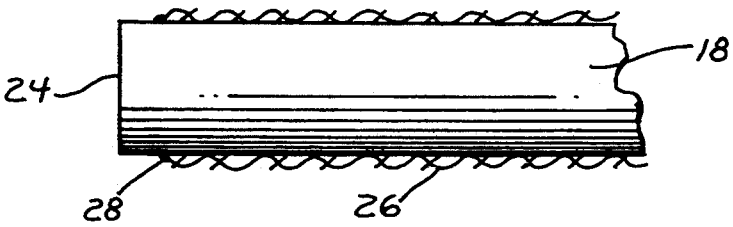
FIG. 3 shows the hollow cylindrical member of the present inventive hose assembly with its reinforcing layer shown in cross-section.

As best shown in FIG. 3, the reinforcing layer 26 is then annularly cut and preferably simultaneously fused at from about 1.3 mm to about 27.9 mm from the first end 24 of the inner liner 18 to form a first end 28 of the reinforcing layer 26. The annular cutting of the reinforcing layer 26 is for the purpose of exposing a portion of the inner liner 18 and can be done by any one of a number of known mechanical techniques. Where it is preferred that the reinforcing layer 26 be cut and simultaneously fused so as to prevent or reduce the probability of subsequent unraveling, it is preferred that an electrical resistance cutter be employed, such as a Flash Cutter Model SS48C, available from Ewald Instruments Corporation, Kent, Conn. 06757.

Figure 4:
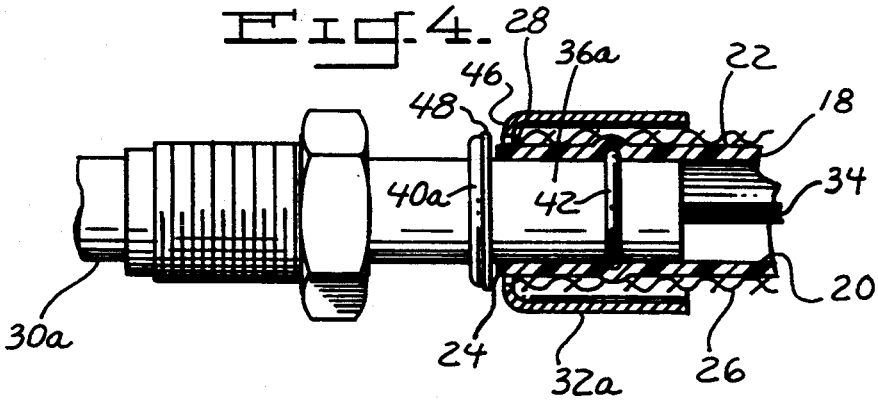
FIG. 4 is a view similar to FIG. 2 prior to a mechanical process for novelly connecting the hollow cylindrical member to coupling means.

As best shown in FIG. 4, a locking collar **32*a* is then positioned on the first end 28 of the reinforcing layer 26 optionally followed by the positioning of a non-conductive or dielectric washer 48 either adjacent thereto on the exterior 22 of the exposed portion or first end 24 of inner liner 18 or adjacent to stop bead 40*a* on insert portion 36*a*. The insert portion 36*a* of the conductive connecting member 30*a* is then inserted into the interior 20 of the inner liner 18 preferably leaving or allowing a distance of up to about 12.7 mm between the first end 24 and the stop bead 40*a*. Between from about 27.6 to about 450 MPa of mechanical pressure is then applied to the collar 32*a* via a mechanical swage or crimp process which serves to apply pressure through the locking collar 32*a* to the reinforcing layer 26 and then to the inner liner 18 causing the first end 24 of the inner liner 18 to flow toward and conform to at least a portion of the stop bead 40*a*. The applied pressure further serves to work the collar 32*a* down in size, thereby forcing the interior 20 of the inner liner 18 into engagement with the insert portion 36*a* of the connecting member 30*a*. The resulting connection has sufficient strength to withstand severe torsional stresses that can result during handling, installation and service and provides a seal to substantially preclude the undesired and gradual escape of fluids over the lifetime of the assembly. Moreover, the resulting connection serves to prevent the connecting member 30*a* from physically and electrically contacting the locking collar 32*a* and the first end 28 of the reinforcing layer 26**.

The invention will be clarified by reference to the following illustrative working examples. The examples are not, however, intended to limit the generally broad scope of the present invention.

WORKING EXAMPLES

Sample Preparation

Two types of hose assemblies were fabricated in an effort to compare the performance and integrity of the present inventive hose assembly and a prior art hose assembly. Hose assembly "A", as used hereinbelow, is intended to designate the hose assembly of the present invention. Hose assembly "PA", as used hereinbelow, is intended to designate a prior art hose assembly. For both assemblies a quantity of PTFE was extruded to form an inner liner having a wall thickness of 0.51 mm and an inner diameter of 7.9 mm. A stainless steel material was then tightly braided about the exterior of the prepared inner liner. The braided inner liner was then cut with an abrasive wheel to form sixteen sections, each measuring 45.7 centimeters in length.

Hose Assembly "A" Preparation

The stainless steel braid of eight braided inner liner sections was annularly cut and fused at a distance of 9.5 mm from each end of the inner liners using an Ewald Instruments Corp. Flash Cutter Model SS48C. Stainless steel locking collars, having minimum inner diameters of 11.2 mm, were positioned over each cut and fused end of the braids. Plated carbon steel couplings, with insert portions having automotive bead style configurations, were then inserted into each end of the inner liners. Each locking collar was then subjected to a mechanical crimp process using a crimper, Model P20C, capable of 1.2×105 kilograms (kg) force (max) available from Finn Power, USA Inc., 710 Remington Road, Schaumburg, Ill. 60173.

Hose Assembly "PA" Preparation

Locking collars, as described in the "Hose Assembly 'A' Preparation" hereinabove, were positioned over each end of the other eight braided inner liners without trimming back the braid. Couplings, also as described above, were then inserted into each end of the inner liners. Each locking collar was then subjected to the same mechanical crimp process set forth above for hose assembly "A":

Test Methods

Hose assemblies "A" and "PA" (two hose assemblies of each type per test) were then subjected to the tests set forth below. Hose assembly "A" was tested for external conductivity with an ohmmeter, prior to and after each test:

TENSILE STRENGTH—Hose assembly "A" and hose assembly "PA" were each mounted separately in a Tensile Test Machine, Model Q, available from Henry L. Scott Co., Providence, R.I. Each assembly was clamped at each engaging portion of each coupling and then pulled at a rate of 50 mm/minute until a load of 136 kg was reached or failure occurred. The subject test was deemed "passed" if the assembly remained in tact when pulled at a maximum load of 136 kg. The subject test was deemed failed if: (a) a coupling was pulled out; or (b) the assembly broke in half.

ROOM TEMPERATURE BURST—ASTM D380—Each assembly was hydrostatically pressurized using a Proof Pressure and Burst Test Stand available from Flotron, Inc., South Windsor, Conn. at a constant rate of 138 MPa/min. until leakage or catastrophic failure occurred.

PRESSURE CYCLE FATIGUE—Each assembly was separately sealably mounted (at the engaging portion of the couplings) into an environmental chamber employing a Refrigeration/Heating System, Model 2-16-2-2-H-AC, available from Cincinnati Sub-Zero Products, Inc.,12011-7 Mosteller Road, Cincinnati, Ohio 45241 and capable of subjecting each assembly simultaneously to the following:

Hydraulic pressure ranging from 0 to 1035 kPa;
Temperature(s) cycling from −40° C. to 177° C.; and
Mechanical vibration of one end of the assembly at 7 (hertz) Hz with a displacement of 12 mm.

For each test, the assembly was filled with hydraulic fluid (MIL-H-83282) so that no air pockets were present in the assembly. A cyclic hydraulic pressure pulse of 0–1035–0 kPa having an approximately square wave form and a 5.0 second duration at both 0 kPa and 1035 kPa was applied. At the same time, a mechanical vibration was imposed to one end of the assembly at 7 Hz and an amplitude of 12 mm. At the same time, the following temperature cycle was imposed: heating to 177° C. and holding the temperature for one hour; and then cooling the chamber to −40° C. and holding the temperature for one hour. The hydraulic, mechanical and temperature cycling was continued until 30,000 pressure cycles elapsed. The test was deemed "passed" if no weapage or leakage of the hydraulic fluid occurred during testing at ambient, −40° C. and at 177° C. temperatures; if no evidence of cracking or deterioration of the assembly was observed; and if the assembly met the requirements of the pressure proof test, described hereinbelow.

The pressure proof test consisted of separately and sealably mounting each assembly (at the engaging portion of the couplings) in a stainless steel tank. One coupling of the test assembly was then capped, nitrogen from a tank of pressurized nitrogen was then introduced into the assembly at the opposite end until an internal pressure of 1070/1000 kPa was achieved and the tank filled with water. This test was deemed "passed" if no leaks were detected. Pressure was released from the assembly from the opposite end to provide a check for blockages.

EXAMPLES 1 AND C1

In these examples, the prepared hose assemblies were subjected to the tests described hereinabove. The results are displayed in Table I.

TABLE I

SUMMARY OF EXAMPLES 1 AND C1

| EXAMPLE<br>Hose Assembly | 1<br>"A" | C1<br>"PA" |
|---|---|---|
| PROPERTIES | | |
| Tensile Strength | Passed[1] | Passed |
| Room Temperature Burst (MPa) | 37.5[1] | 37.0 |
| Pressure Cycle Fatigue | Passed[1] | Passed |

[1]assembly remained externally non-conductive after the test was performed.

Example 1 demonstrates that the hose assembly of the present invention offers external non-conductivity while displaying comparable mechanical properties to those displayed by prior art Hose Assembly "PA".

Although the invention has been shown and described with respect to detailed embodiments thereof, it would be understood by those skilled in the art that various changes in form and detail thereof may be made without departing from the spirit and scope of the claimed invention.

Having thus described the invention, what is claimed is:

1. A hose assembly comprising a hollow cylindrical member and coupling means, wherein said hollow cylindrical member comprises: an inner liner having an interior, an exterior and a first end; and a reinforcing layer, disposed about said exterior of said inner liner and having a first end; wherein said coupling means comprises: a connecting member having an engaging portion for engaging a fitting, an insert portion for engaging said interior of said inner liner and a stop bead disposed between said engaging portion and said insert portion; and a locking collar disposed about said first end of said reinforcing layer for forcing said interior of said inner liner into engagement with said insert portion of said connecting member; and wherein said first end of said inner liner abuts and conforms to at least a portion of said stop bead for preventing said connecting member from physically and electrically contacting said locking collar and said first end of said reinforcing layer.

2. The hose assembly of claim 1 wherein said inner liner is a fluorocarbon polymer inner liner wherein said fluorocarbon polymer is selected from the group consisting of polytetrafluoroethylene, copolymers of tetrafluoroethylene and hexafluoroethylene, perfluoroalkoxyl resins, polymers of ethylenetetrafluoroethylene and mixtures thereof.

3. The hose assembly of claim 1 wherein said reinforcing layer comprises a metallic braid.

4. The hose assembly of claim 1 wherein said inner liner further comprises a conductive means that is coextensive with said interior of said inner liner for conducting electrical charge through said inner liner.

5. The hose assembly of claim 1 wherein said hose assembly further comprises at least one dielectric washer located on said insert portion of said connecting member between said locking collar and said stop bead and wherein said first end of said inner liner abuts and conforms to at least a portion of said washer.

6. The hose assembly of claim 1 wherein said hose assembly further comprises at least one dielectric washer located on said exterior of said inner liner contiguous to said locking collar.

* * * * *